US007043186B2

(12) United States Patent
Segerer et al.

(10) Patent No.: US 7,043,186 B2
(45) Date of Patent: May 9, 2006

(54) FIXING STATION AND METHOD FOR THE UNIFORM FIXING OF TONER IMAGES ON A CARRIER MATERIAL WITH THE AID OF A MOVABLE COVERING DEVICE

(75) Inventors: Peter Segerer, Olching (DE); Matthias Gubatz, Poing (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 10/920,895

(22) Filed: Aug. 18, 2004

(65) Prior Publication Data

US 2005/0042004 A1 Feb. 24, 2005

(30) Foreign Application Priority Data

Aug. 21, 2003 (DE) ..... 103 38 516

(51) Int. Cl.
*G03G 15/20* (2006.01)

(52) U.S. Cl. ..... 399/335; 399/337

(58) Field of Classification Search ..... 399/335, 399/329, 336

See application file for complete search history.

(56) References Cited

U.S. PATENT DOCUMENTS 6,085,060 A * 7/2000 Goldmann et al. ..... 399/335
6,449,458 B1 9/2002 Lang et al.

FOREIGN PATENT DOCUMENTS

DE 198 27 210 12/1999

* cited by examiner

*Primary Examiner*—Quana Grainger
(74) *Attorney, Agent, or Firm*—Schiff Hardin LLP

(57) ABSTRACT

A fixing station and a method for fixing toner images on a carrier material. The fixing station has an arrangement for moving a carrier material in a first direction and in a second direction opposite the first direction, a heat radiation source, which heats the carrier material to fix a toner thereon, and a covering device which is arranged between the carrier material and the heat radiation source and is movable parallel to the direction of the carrier material between an opened and closed position, so that while in the closed position, it blocks radiation from reaching the carrier device and in an opened position allows the radiation to heat the carrier material. The method includes delaying the opening and closing of the covering device so that a previously fixed area of the carrier material is not subjected to additional radiation from the heat radiation source.

31 Claims, 3 Drawing Sheets

FIXING STATION AND METHOD FOR THE UNIFORM FIXING OF TONER IMAGES ON A CARRIER MATERIAL WITH THE AID OF A MOVABLE COVERING DEVICE

BACKGROUND OF THE INVENTION

The invention relates to a fixing station and a method for the uniform fixing of toner images on a carrier material. The fixing station comprises a heating device having at least one heat radiation source emitting radiation toward the carrier material and a covering device with which an undesired incidence of radiation on the carrier material is prevented.

In electrographic printers or copiers, the toner image transferred from an intermediate carrier, generally a photoconductor, to the carrier material, generally paper, is fixed, i.e. it is joined to the carrier material in a smear and abrasion resistant way. Nowadays, heat-pressure fixing is commonly used in electrophotography. Without any preheating of the carrier material, for example with the aid of a heating saddle, this type of fixing is limited in its processing speed to about 0.5 m/s to 0.7 m/s. In the duplex printing mode, in which the front side and the rear or back side of a carrier material is printed, the fixing process is relatively difficult since still smearable toner images are applied to both sides. A high fixing quality together with a simultaneous fixing of the front side and the rear side of the carrier material can only be achieved with relatively soft fixing rollers, for example silicone rollers. These fixing rollers have a short life and are uneconomical. In addition, the guiding of the paper is problematic in the case of two opposite fixing rollers in particular when simultaneously fixing the front and the rear side of an endless carrier material.

U.S. Pat. No. 6,449,458 B1, whose disclosure is incorporated herein by reference thereto and which claims priority from German 198 27 210, discloses a fixing station for the simultaneous contact-free fixing of the front and the rear side of an endless carrier material with the aid of a heat radiation source. When fixing with the aid of this fixing station, a smearing of the not yet fixed toner images is avoided. In the case of the fixing station known from U.S. Pat. No. 6,449,458 B1, an additional covering device for the interruption of the ray path of the heat radiation source is provided, which covering device can be moved into the ray path between the heat radiation source and the carrier material. With the transport of the carrier material, the covering device is opened at the transporting speed of the carrier material, and after stopping the transport of the carrier material the covering device is closed in the opposite direction at the same speed.

Due to the operational sequence, known printers or copiers for printing endless carrier material are not only operated in the continuous printing mode but also in the intermittent printing mode. For example, the toner images of several color separations are transferred successively onto a transfer band, during which operation the transport of the carrier material is stopped. In addition, the transport of the carrier material is interrupted in the so-called start-stop mode, in the case of automatic cleaning processes and in the case of an interruption of the print data stream.

It is necessary that there is a smooth transition between a second printed image generated in a second printing process and a printed image generated in a first process. This requires a carrier material transport which, in particular, takes into account periods during which the transfer bands are swiveled to and away from the paper web as well as a predetermined acceleration and deceleration of the travel of the carrier material after every printing process. The acceleration and deceleration of the travel of the carrier material in a printing process are necessary for the synchronization with elements of the image generating unit of the printer or copier, in particular with a character generator, a photoconductor and a transfer element. In doing so, a backward pulling of the carrier material takes place, i.e. a transport in the opposite direction to the direction in which the carrier material is transported during printing. By means of this backward pulling of the paper, the positional displacements of the carrier material during the deceleration of the travel of the carrier material after the first printing process and the acceleration of the travel before the second printing process are compensated.

In the already mentioned fixing station, even in the case of a screening-off of the radiation of the heat radiation source as a result of the backward pulling of the carrier material, heat radiation is, however, once again supplied to an already completely fixed area of the carrier material by the opening of the covering device during the start of the carrier material transport in the second printing process. This results in visible differences in the fixed printed image. In addition, the stress on the carrier material varies, in particular additional moisture is extracted from a paper web by the additionally supplied radiation and as a result thereof, the paper web is further stressed.

SUMMARY OF THE INVENTION

The object of the invention is to provide a method and a fixing station which operates at high process speed and guarantees a high printing quality in particular by means of a uniform fixing.

This object is achieved by the inventive method.

According to the inventive method, after moving the carrier material in the second direction of movement, the covering device is opened during the subsequent movement of the carrier material in the first direction of movement in a delayed manner such that at least an already completely fixed area of the carrier material is not again subjected to the radiation of the heat radiation source. As a result, the area which has already been fixed, is not fixed once again. However, a following toner image which has not already been completely fixed, is again fixed due to the opening of the covering device.

Thus, from a visual standpoint, there results a uniform surface of the fixed toner material, which is of importance for the visual impression of a print page in particular when a toner image presented on a print page has been fixed differently in at least two areas. Then, the luster and the optical density of the toner image surface vary and are visible when the print page is viewed. As a result, the print image of a print page is not of high-quality for a viewer. By means of the method according to the invention, a uniformly fixed toner image or, respectively, print image, is generated.

A second aspect of the invention relates to a fixing station for fixing toner images on a carrier material. The fixing station comprises a heating device having at least one heat radiation source which emits radiation toward the carrier material. A drive means is provided which conveys the carrier material in a first direction of movement and in a second direction of movement substantially opposite to the first direction of movement. The fixing station includes a covering device which can be moved substantially parallel to the first and second directions of movement of the carrier material and is movable into the ray path between the heat radiation source and the carrier material.

During the transport of the carrier material in the first direction of movement, the covering device is opened so that toner images on the carrier material can be fixed. The covering device is closed when the carrier material is conveyed in the second direction of movement. After transport of the carrier material in the second direction of movement, the covering device is opened during the subsequent transport of the carrier material in the first direction of movement in a delayed manner such that the radiation is at least not incident on an already completely fixed area of the carrier material.

What is achieved by this inventive fixing station is that the toner image is uniformly fixed on the carrier material, and print images of high-quality can be generated. Further, the carrier material, in particular a paper web, is not unnecessarily stressed.

For the purposes of promoting an understanding of the present invention, reference will now be made to the preferred embodiments illustrated in the drawings and specific language will be used to describe the same. It will nevertheless be understood that no limitation of the scope of the invention is thereby intended, such alterations and further modifications in the illustrated devices and/or method, and such further applications of the invention as illustrated therein being contemplated as would normally occur now or in the future to one skilled in the art to which the invention relates. Embodiments of the invention are shown in the figures.

DESCRIPTION OF THE PREFERRED EMBODIMENTS

Figure 1:
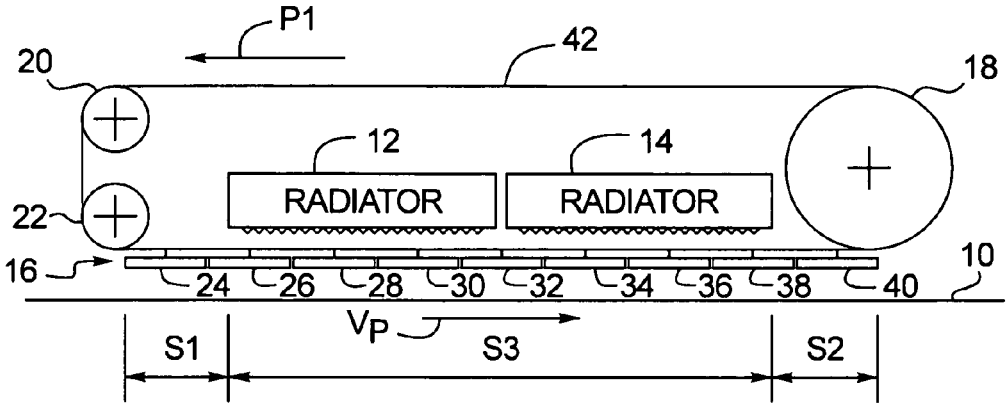
FIGS. 1 and 1*a* are schematic longitudinal cross-sectional views of a fixing station having a covering device of the blind-type.
Figure 1A:
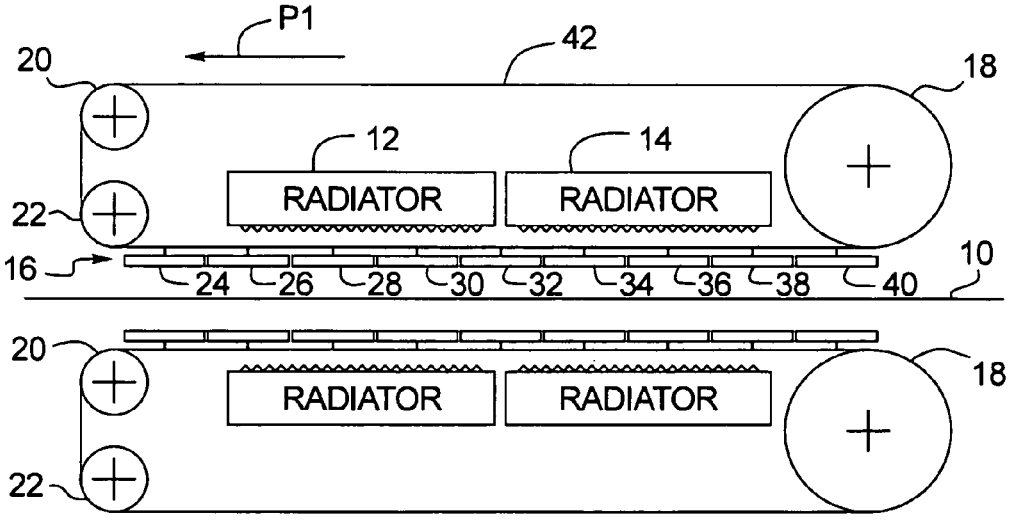

FIG. 1 shows a longitudinal cross-section of the fixing station according to the invention. This fixing station is used in a high-performance printer which prints a paper web 10 on both sides. In the illustration according to FIG. 1, only the upper part of the fixing station is shown, with which heat energy for fixing toner images is applied to the top side of the paper web 10. An identical device shown in FIG. 1*a* is provided for the underside of the paper web 10 for fixing toner images on the underside. The fixing station includes two heat radiation sources 12, 14, which are implemented as foil radiators.

In this embodiment, such a foil radiator includes 50 μm thick strips which acquire a temperature of <900° C. when a current is applied. The advantage of a foil radiator is that it has a low heat capacity and can thus be heated up quickly and likewise cools down quickly. Other heat radiation sources which can be used are ceramic panel radiators, in which the heating coil is embedded in a ceramic member. Quartz radiation sources in which the coiled filament is mounted in quartz tubes can likewise be used.

Between the heat radiation sources 12, 14 and the paper web 10 a covering device 16 is provided which can be moved into the ray path between the radiation source 12 and the paper web 10. In the present case, the covering device 16 comprises strip-shaped lamellae 24 to 40 which are put together in the manner of a blind 16. As a result, the blind 16 is flexible in the direction of movement of the paper web 10 and can be deflected at deflection rollers 18, 20, 22. One of the deflection rollers 18, 20, 22, e.g. the deflection roller 22, is driven by a drive unit (not illustrated).

The strip-shaped lamellae 24 to 40, which form the blind 16, are clamped between two rotating toothed belts 42 (only one toothed belt 42 is visible in FIG. 1). By a forward or backward movement of the toothed belts 42, the blind 16 can be moved into the ray path between the radiation source 12 and the paper web 10 in order to shield the paper web 10 from heat radiation being incident thereon. The length of the blind 16 is dimensioned so that, in its closed condition, it shields the paper web from the entire radiation-emitting area of the heat radiation sources 12 and 14. As an alternative to the toothed belts 42, two wire cables or chains can be used.

The transport mechanism with toothed belt or wire cable drive is provided on both sides outside the radiation area of the heat radiation sources 12, 14. The deflecting device formed by the deflection rollers 18, 20, 22 is thus compact and requires only little space.

The blind 16 is subjected to relatively high temperature differences. In the opened condition, it is at almost room temperature, and in the closed condition the covering device 16 can acquire a temperature of up to about 600° C. Owing to the changes in length as a result of the differences in temperature, a tensioning device (not illustrated) is provided at least at one deflection roller 18. This tensioning device creates a constant tension within the toothed belt 42 so that the blind 16 is likewise tensioned. The tensioning device can, for example, be implemented by a belt tightener with a permanently applying spring force. In order to compensate for a change in length as a result of the differences in temperature in a direction transverse to the paper web 10, the deflection rollers 18, 20, 22 are arranged axially adjustable.

The individual lamellae 24 to 40 consist of a high-temperature resistant material, for example sheet steel, having a typical thickness of 0.1 to 0.3 mm. Materials in the form of bands or plates or cloths having a low heat conduction, such as glass fibers, silicate fibers or ceramic fiber paper can also be used, and guarantee that the heat load on the paper web 10 is as low as possible in the closed condition. For stabilization purposes, the lamellae can be applied to a temperature resistant tear-proof support grid. The afore-mentioned fiber products can also be used together with metals; in this case, the fiber products serve for an additional heat insulation.

In other embodiments, the blind 16 or, respectively, the lamellae 24 to 40 are wound up like a coil, i.e. the rotating deflection device illustrated in FIG. 1 is replaced by a take-up reel and a take-off reel, onto which the blind or, respectively, the band is wound on and off.

The lamellae 24 to 40 can be formed of a relatively inflexible material, for example ceramics or hollow steel profiles. Such hollow profiles, which in turn can be assembled of U-profiles, are preferably flushed with air for cooling.

The movement of the blind 16 depends on the operating state of the paper web 10. When the paper web 10 is stopped, the blind 16 is closed at the speed $v_R$ according to the relation: $v_R=-v_P$, where $v_P$ is the transport speed of the paper web 10. This means that even in the case of a sudden standstill of the paper web 10, for example as a result of a paper jam or as a result of an operation-dependent stop of the paper web 10, the fixing process of the section of the paper web 10 present under the heat radiation source 12 will be continued for as long as heat radiation would have been applied thereto during normal transport. Thus, despite the stoppage of the paper web 10, the section present under the heat radiation sources 12, 14 is still sufficiently exposed in order to fix the toner images.

When the paper web 10 is conveyed further at the speed $v_P$, the covering device 16 is opened in the same direction at the speed $v_R$. Thus, the relation: $v_R=v_P$ applies. As a result, the correct amount of heat radiation required for fixing is applied to the section of the paper web 10 newly arriving under the heat radiation source 12. The preceding section of the paper web 10 is not overexposed.

The covering device 16 according to FIG. 1 is flexible. In an alternative embodiment, it is, however, possible to use a rigid plate, which, if necessary, can be moved into the ray path between the heat radiation source 12 and the paper web 10 by means of a drive mechanism.

The heat radiation source 12 has a preferred radiation temperature in the range of 500° C. to 800° C. Its maximum radiation intensity is at a wavelength of >2 μm.

During printing in an electrographic printer so-called start-stop-processes occur for various reasons, in the case of which the paper transport has to be stopped for a certain amount of time; for example in the case of an interruption of the electronic data stream, in the case of necessary cleaning processes in the printing unit or in the case of specific paper transport movements.

The arrow $v_P$ illustrated in FIG. 1 indicates a first transport direction of the paper web 10, in which the paper web 10 is conveyed at the printing speed $v_P$, then, the blind 16 being generally open so that the heat radiation of the radiators 12, 14 is incident on the paper web 10 for fixing toner images on the paper web 10. When the printing process is interrupted, i.e. after a first printing process has been finished and before the beginning of a second printing process, the paper web 10 is pulled backward so that the front edge of a print image generated in a subsequent second printing process is transfer-printed at the rear edge of a print image generated in a first printing process. The distance covered for decelerating the paper web 10 when the first printing process is finished and for accelerating the paper web 10 in the second printing process thus has to be traveled by the paper web 10 in the opposite direction of the arrow $v_P$, i.e. in a second direction of movement after finishing the first printing process. The second direction of movement is thus substantially opposite to the first direction of movement.

During the transport of the paper web 10 in the second direction of movement, the covering device 16 is closed. During the subsequent transport of the paper web 10 in the first direction of movement in the second printing process, the covering device 16 is inventively not opened until the paper web 10 has been already conveyed so far that it has already been guided past the point at which the covering device 16 is opened. A following, not yet completely fixed area is, however, subjected to the radiation in order to be completely fixed.

For starting and stopping the transport of the paper web 10, the paper web 10 is linearly accelerated each time. This linear acceleration is also referred to as a ramp acceleration. The ramp acceleration is achieved by a corresponding control of a drive unit of the paper web 10. Likewise, during opening and closing of the covering device 16, the same is accelerated with a ramp acceleration to transport speed $v_R$ and is decelerated with the aid of a ramp acceleration having a negative slope. In FIG. 1, a first acceleration area of the covering device 16 is referenced by S1 and a second acceleration area is referenced by S2. For closing the covering device 16, the lamellae 24 to 40 are conveyed in the direction of the arrow P1 between the heat radiators 12, 14 and the paper web 10.

In other embodiments, other ramp accelerations, in particular a sinusoidal acceleration for accelerating the paper web 10 and/or the covering device 16 are used as well.

In the acceleration area S2, the covering device 16 is accelerated so that the covering device 16 is not driven at full transport speed $v_R$ in this area but rather is only accelerated to that speed in that area S2. Following the area S2, the covering device 16 is driven at a constant speed in the area S3 up to the area S1. In the area S1, the drive speed $v_R$ of the covering device 16 is uniformly reduced until the covering device 16 stands still, i.e. the covering device 16 is decelerated from transport speed to standstill.

For the subsequent opening in the second printing process, the covering device 16 is uniformly accelerated according to the ramp function in the area S1, as a result whereof the area S1 is not cleared at a uniform speed. Subsequently, the covering device 16 is driven at a constant speed so that in an area referenced by S3 and lying between the areas S1 and S2 the radiation area is uniformly extended at a constant speed. Subsequently, the covering device 16 is again decelerated in the area S2 according to a ramp function and comes to a standstill at the end of the area S2.

In the case of the fixing station according to FIG. 1, the heat radiators 12, 14 are exclusively arranged in the area S3 between the areas S1 and S2 so that the ray path of the radiators 12, 14 is cleared at a constant speed. The first direction of movement of the paper web 10 for fixing toner images on the paper web 10 has the same direction as the opening direction of the covering device 16. It is therefore possible that the front edge of the lamella 24 forms a fixing edge during the opening of the covering device 16. A toner image which is present under the lamellae 24 to 40 at the point in time of opening the covering device 16 is not fixed once again since the covering device 16 interrupts the ray path of the heat radiation emitted by the heat radiators 12, 14.

A following toner image is, however, completely fixed since the covering device 16 does not impede the ray path of the heat radiation onto this area. The fixing boundary results from the toner image positioned at the beginning of the area S3 under the lamella 24, with, as already mentioned, the front edge, i.e. the edge of the lamella 24 forming the outer edge of the covering device 16 continuously clearing the path of the heat radiation of the heat radiators 12, 14 in the area S3, the opposite paper web 10 being conveyed at the same speed in the opening direction. Only at the end of the area S3, at which already the entire ray path of the radiators 12, 14 has been cleared, the covering device 16 is uniformly decelerated to standstill with a negative acceleration.

Figure 2:
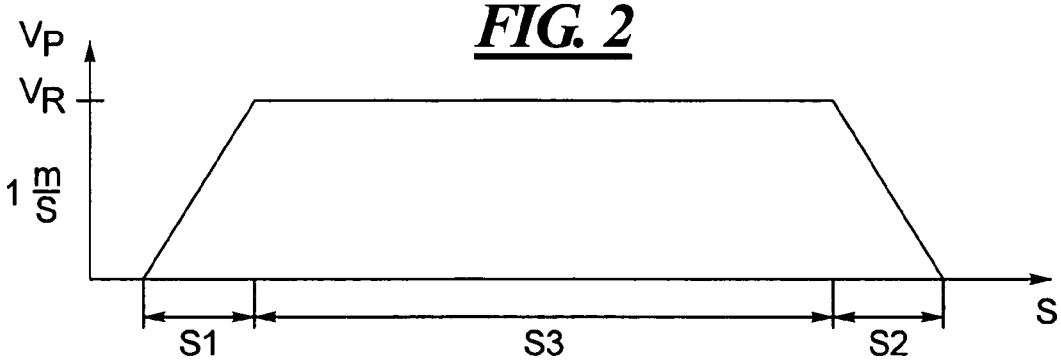
FIG. 2 is a speed-distance diagram illustrating the transport speed of the blind according to FIG. 1.

FIG. 2 is a speed-distance diagram illustrating the acceleration of the covering device 16 according to FIG. 1. Like elements have like reference characters. As already explained in connection with FIG. 1, the covering device 16 is uniformly accelerated to the blind speed $v_R$ or, respectively, magnitude-wise to the paper speed $v_P$ in the area S1. In the area S3, the covering device 16 is driven at a constant speed so that the area S3 below the heat radiators 12, 14 is uniformly opened. Subsequently, in the area S2, the covering device 16 is decelerated from the speed $v_R$ to the speed 0, i.e. to standstill.

In the same way as the speed-distance diagram according to FIG. 2, there results a speed-time diagram for the acceleration and the deceleration of the covering device 16. In a first time interval T1 (not illustrated), the covering device 16 is uniformly accelerated to the speed $v_R$ or, respectively, $v_P$, subsequently driven at a constant speed in a time interval T3 and uniformly decelerated to a standstill in a time interval T2.

The fixing behavior of the fixing station according to FIG. 1 with respect to different operating states is explained below with the aid of the speed-time diagrams illustrated in FIGS. 3 to 7. In the following, the blind 16 is generally referred to as covering device. In FIGS. 3 to 7, speed curves of the paper web 10 are illustrated in solid lines and speed curves of the covering device 16 are illustrated by means of broken lines.

At the time t1, after a backward pulling of the paper web 10, that has been carried out after a preceding printing process, the transport of the paper web 10 is started in the direction of the arrow $v_P$ after the start of a second printing process. In doing so, the paper web 10 is uniformly accelerated up to a time t2 to the transport speed $v_P$ of 1 m/s and is conveyed further at a constant speed up to the time t4. At the time t3, the section of the paper web that has been pulled backward during backward pulling of the paper web 10, has again been conveyed in the direction of the arrow $v_P$. At this point in time, the covering device 16 is already opened so far that the front edge of the lamella 24 has reached the boundary between the areas S2 and S3 according to FIG. 2 and, from the time t3, starts to clear the ray path of the heat radiation source 12 and, subsequently, of the heat radiation source 14.

At the time t4, the toner image generated in the second printing process has been transferred onto the paper web 10, and the transport speed of the paper web 10 is uniformly reduced up to the time t6. Both the acceleration of the paper web 10 and the reduction of the transport speed of the paper web 10 take place by means of a uniform acceleration, also referred to as ramp acceleration.

At the time t5, the covering device 16 has been accelerated so much that it has the same transport speed, i.e. opening speed, as the already reduced transport speed $v_P$ of the paper web 10. The opening speed $v_R$ of the covering device 16 is reduced from the time t5 up to the time t6 in the same way as the drive speed $v_P$ of the paper web 10. Thus, at the time t6, the paper web 10 and the covering device 16 stand still. The covering device 16 then at least clears an area of the radiation generated by the heat radiator 12, i.e. the ray path between the heat radiator 12 and the paper web 10. As a result, the opposite paper web 10 is subjected to the heat radiation in this area so that a toner image present thereon is fixed. Thus, the covering device 16 remains open in this position up to the time t7.

At the time t7, the covering device 16 is accelerated up to the time t8 in the direction of the arrow P1 for closing the opened area of the covering device 16 and subsequently again decelerated up to the time t9. The time interval between the times t7 and t8 substantially corresponds to the time interval between the times t3 and t5, and the time interval between the times t8 and t9 substantially corresponds to the time interval between the times t5 and t6. The acceleration ramps for the acceleration to transport speed and for the reduction of the transport speed have the same slope, however opposite in sign.

From the time t9, the covering device 16 is at least closed so far that the ray path between the heat radiation sources 12, 14 and the paper web 10 is interrupted. From the time t10, the backward pulling of the paper web is carried out after the second printing process, the paper web 10 being accelerated in opposite direction to the arrow $v_P$ with the aid of an acceleration ramp illustrated in FIG. 3. The further speed curve of the backward pulling of the paper web 10 is not illustrated in FIG. 3 and the following figures. In the present embodiment, the time interval between the times t1 and t2 as well as between the times t4 and t6 amounts to approximately 200 ms. The time interval between the times t3 and t4 corresponds to the time of the print image generation in the current printing process, i.e. the time required by a character generator for generating a charge image which is to be generated as a print image on the paper web 10 in the second printing process.

Figure 3:
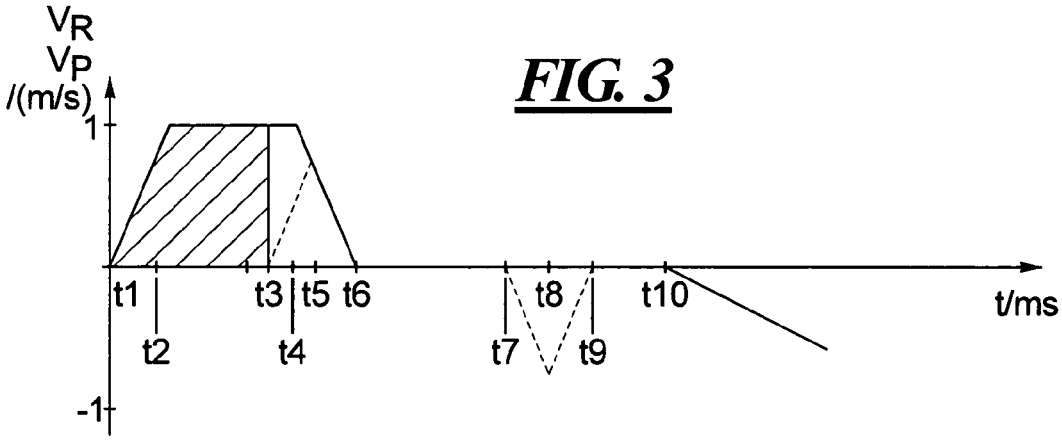
FIG. 3 is a speed-time diagram illustrating the speed of the paper web and the speed of the blind during the incomplete opening of the blind.

The duration of the print image generation in the second printing process according to FIG. 3 amounts to 77 ms, as a result whereof a print image having a length of 7.7 cm is generated at a printing speed of 1 m/s. At the time t6, the covering device 16 is likewise opened by 7.7 cm so that an area of a print image generated in the preceding first printing process or possibly in another earlier printing process, is fixed over a length of 7.7 cm. The print image generated in the second printing process is transferred onto the paper web 10 as a toner image after inking the charge image with toner. However, it is not necessarily fixed on the paper web 10 in the second printing process. In the present embodiment, the fixing station is arranged downstream of a printing unit so that the toner image generated in the second printing process has not yet reached the fixing station after the transfer-printing even given a deceleration travel. The print image generated in the second printing process is, dependent on the length of the print images generated in the following printing processes, only supplied to the fixing station for fixing in one of these following printing processes. However, at least a longitudinal area of a toner image previously generated is fixed on the paper web 10 over the length of the print image generated in the current second printing process.

Figure 4:
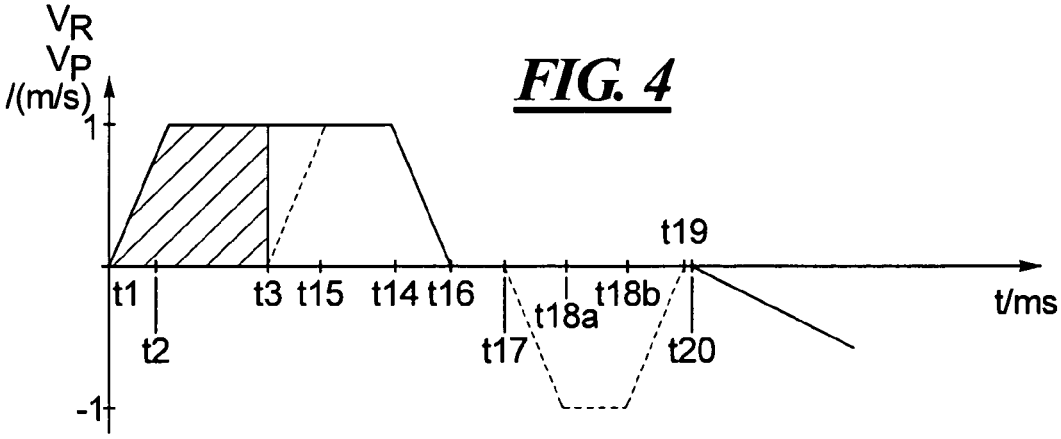
FIG. 4 is a speed-time diagram according to FIG. 3 illustrating the speed curves in the case of a completely opening blind.

FIG. 4 illustrates the speed-time diagram according to FIG. 3, a longer print image being generated in the second printing process according to FIG. 4 as compared to the one of the second printing process according to FIG. 3. The transport of the paper web 10 is started at the time t1, the paper web 10 being accelerated to transport speed $v_P$ up to the time t2 and subsequently being conveyed further at the speed $v_P$ up to the time t3 and further up to the time t14. As in the case of the diagram according to FIG. 3, at the time t3, the distance traveled during the previously carried out backward pulling of the paper web 10 has again been traveled in the transport direction $v_P$ so that the boundary between the fixed area and the non-fixed area is situated under the front edge of the lamella 24. From the time t3 up to the time t15, the covering device 16 is accelerated to its transport speed $v_R$. Thus, at the time t15, the boundary between the fixed print image and the non-fixed print image is situated at the front edge of the heat radiation source 12 together with the front edge of the lamella 24.

The transport speed $v_R$ of the covering device 16 substantially corresponds to the magnitude of the transport speed $v_P$ of the paper web 10. The covering device 16 is opened from the time t15 up to the time t14 at the transport speed $v_R$, and from the time t14, the opening speed $v_R$ of the covering device 16 is reduced in the same manner as the transport speed $v_P$ of the paper web 10. At the time t16, the covering device 16 is not yet fully opened so that only a part of the ray path between the heat radiation sources 12, 14 and the paper web 10 has been cleared by the covering device 16.

The covering device 16 remains open in this position up to the time t17 at which the covering device 16 is accelerated in the direction of the arrow P1 for closing the covering device 16. The covering device 16 is accelerated to a transport speed of likewise 1 m/s from the time t17 up to the time t18*a* and is driven further at this closing speed up to the time t18*b*. From the time t18*b* up to the time t19, the drive speed of the covering device 16 is uniformly reduced up to standstill. During standstill of the covering device 16 at the time t19, the ray path between the heat radiation sources 12, 14 and the paper web 10 is completely interrupted. From the time t20, a backward pulling of the paper web 10 is carried out after the second printing process, as already described.

The time interval between the times t3 and t14 substantially corresponds to the time interval required by the character generator for generating a print image in the embodiment according to FIG. 4. By the sequence illustrated in FIG. 4, the covering device 16 is opened so far that a longitudinal section of the paper web 10 lying underneath and substantially corresponding to the length of the print image generated in the second printing process, is fixed. Thus, the covering device 16 does reach the maximum speed $v_R$ of 1 m/s during opening and closing, however, the covering device 16 is, as already described, not fully opened. The opening covering device 16 is decelerated synchronously to the paper web 10 and comes to a standstill in the resulting stop position.

The opened area is not closed until the exposure time, i.e. the required fixing period, has been reached so that the area lying opposite the heat radiation sources 12, 14 and in which the ray path between the radiation heat sources 12, 14 and the paper web 10 has been cleared, has been fixed. The closing of the covering device 16 takes place with the same speed curve as the opening, however in opposite direction.

Figure 5:
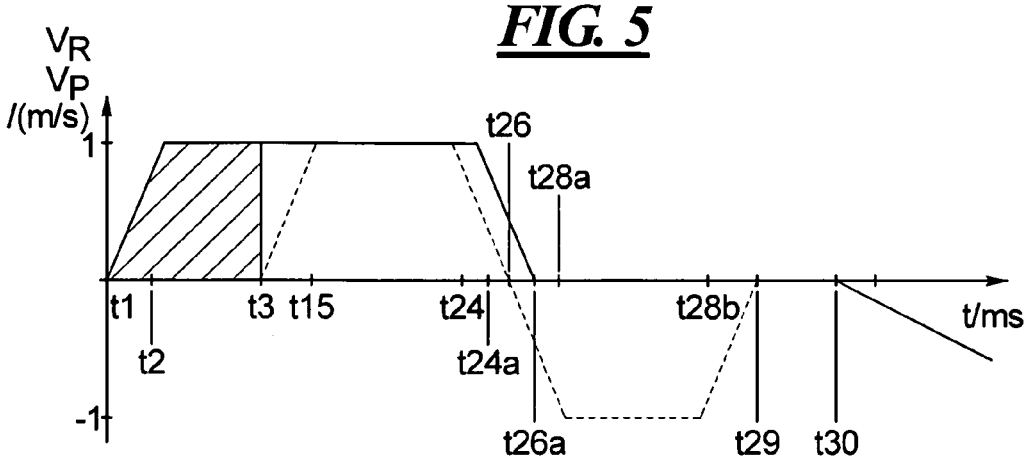
FIG. 5 is a speed-time diagram according to FIGS. 3 and 4 illustrating a transition area between complete and incomplete opening of the blind.

FIG. 5 illustrates the speed-time diagram according to FIGS. 3 and 4, however, in contrast to the diagram according to FIG. 4, a print image of a still greater length being generated in the second printing process so that the covering device 16 is completely opened. At the time t3, it is started to uniformly accelerate the covering device 16 for opening until it has reached the opening speed $v_P$ of 1 m/s at the time t15. At the time t24, the almost opened covering device 16 is decelerated until it has the speed of 0 m/sec at the time t26. As already described, the paper web 10 is conveyed from the time t2 up to the time t24*a* at a constant speed and subsequently uniformly decelerated up to the time t26*a*, i.e. up to the standstill of the paper web 10.

After the standstill of the covering device 16, the same is fully opened at the time t26 and subsequently accelerated to a speed $v_R$ of 1 m/s up to the time t28*a* for closing in the direction of the arrow P1. At this speed $v_R$, the covering device 16 is conveyed up to the time t28*b*, at which the covering device 16 is almost closed. At the time t28*a*, the front edge of the lamella 24 is at the boundary between the areas S2 and S3, and at the time t28*b* at the boundary between the areas S1 and S3. Likewise, at the time t15 the front edge of the lamella 24 is at the boundary between the areas S1 and S3, and at the time t24 at the boundary between the areas S3 and S2. From the time t28*b*, the transport speed of the covering device 16 is uniformly reduced up to the time t29, the covering device 16 being closed and standing still at the time t29. At the time t30, the backward pulling of the paper web 10 is started.

In the speed curves of FIG. 5, a linear interpolation takes place between a driving of the covering device 16 for complete opening and for incomplete opening. By means of this linear interpolation, however, an exposure error occurs so that not the exact same amount of radiation is supplied to every fixed area of the paper web 10.

Figure 6:
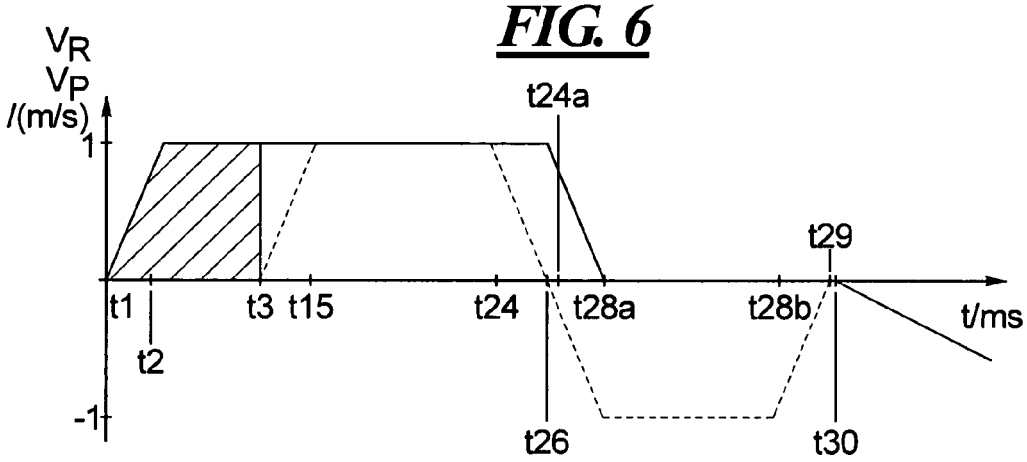
FIG. 6 is a speed-time diagram, which is similar to that illustrated in FIG. 5, illustrating the borderline case between complete and incomplete opening.

FIG. 6 is another speed-time diagram which likewise, as the diagram according to FIG. 5, illustrates the speed curve with linear interpolation in the borderline area between incomplete and complete opening of the covering device 16. Up to the time t24, the speed curves correspond to the speed curves illustrated in FIG. 5. From the time t24, the transport speed $v_R$ of the covering device 16 is uniformly reduced up to the speed 0 m/s in agreement with FIG. 5, the covering device 16 then being fully opened at the time t26.

From the time t26, the covering device 16 is uniformly accelerated in the direction of the arrow P1 up to the time t28*a*, until the covering device 16 has reached a transport speed of $v_R$ of 1 m/s at the time t28*a*. In agreement with FIG. 5, the transport speed of the covering device 16 is maintained up to the time t28*b* and subsequently uniformly reduced up to the time t29, until the covering device 16 stands still at the time t29 and the covering device 16 is completely closed.

In contrast to the speed curves according to FIG. 5, the paper web 10 is conveyed up to the time t24*a* at a transport speed $v_P$ of 1 m/s, and subsequently from time t24*a* up to the time t28*a*, the transport speed $v_P$ is uniformly reduced up to the standstill of the paper web 10. From the time t30, the backward pulling of the paper web 10 takes place, in a way similar to that already described in connection with FIGS. 3 to 5.

Figure 7:
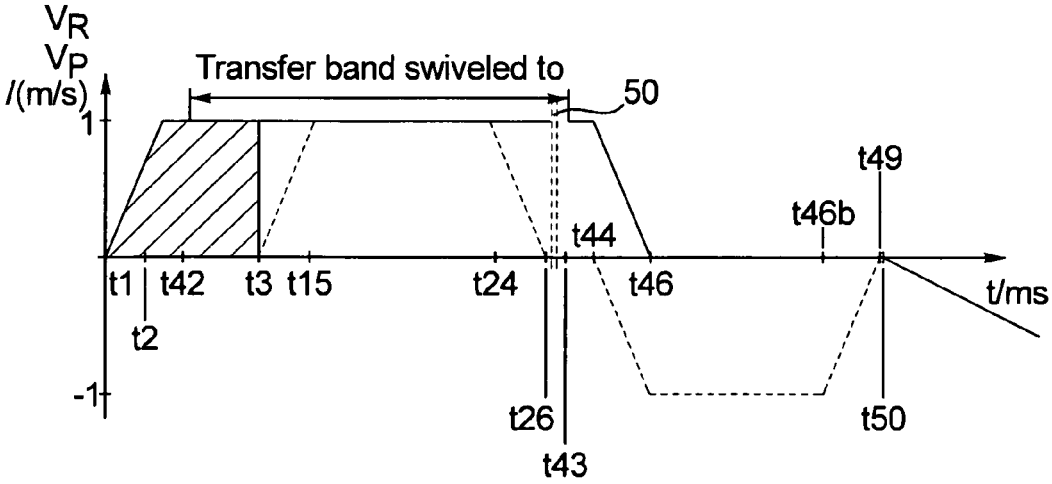
FIG. 7 is another speed-time diagram illustrating the complete opening of the blind.

FIG. 7 is a speed-time diagram illustrating the speed curves of the covering device 16 and of the paper web 10 similar to the diagrams 3 to 6. The speed curves up to the time t24 substantially correspond to the speed curves illustrated in FIGS. 5 and 6 up to this time t24. From the time t24, the transport speed $v_R$ of the covering device 16 is uniformly decelerated up to the time t26 and stands still at the time t26 in fully opened position.

The paper web 10 is conveyed up to the time t44 at a transport speed $v_P$ of 1 m/s in the direction of the arrow $v_P$. Subsequently, the transport speed $v_P$ is uniformly reduced up to the time t46, with the paper web 10 standing still at the time t46. At the time t44, the covering device 16 is accelerated in the direction of the arrow P1 for closing the covering device 16. At the time t46, the covering device 16 has reached a closing speed of $v_P$of 1 m/s, the covering device 16 being driven at a uniform speed $v_R$ of 1 m/s up to the time t46*b*. Subsequently, the speed $v_R$ of the covering device 16 is reduced up to the time t49. At the time t49, the covering device 16 is completely closed and stands still. At the time t50, the backward pulling of the paper web 10 begins and is accelerated.

Further, in FIG. 7 an area is specified by the marked points in time t42 and t43 in which area a transfer band is swiveled to the paper web 10 for the transfer of a toner image generated in the second printing process from the transfer band to the paper web 10. Thus, the transfer band contacts the paper web 10 in the time interval between the time t42 and the time t43. In the remaining time illustrated in FIG. 7 the transfer band is swiveled away from the paper web 10. The area 50 between the two vertical broken lines in the diagram indicates an area of arbitrary length so that the speed curve of the paper web 10 and of the covering device 16 illustrated in FIG. 7 can be arbitrarily extended. Therefore, a time interval of arbitrary length can exist between the two broken lines without the speed curves $v_R$ and $v_P$ before and after this area 50 indicated by the broken lines changing.

In embodiments other than those illustrated in FIGS. 1 to 7, the heat radiators 12, 14 at least extend into the areas S1 and S2 or they completely overtop them. As a result, the maximum blind speed $v_R$ at the edges of the heat radiators 12, 14 has not been reached yet or, respectively, is no longer reached. The radiation period of the paper web in the acceleration areas then has to be adapted accordingly so that a uniform radiation period is achieved.

For putting the inventive teaching into practice, it might be necessary in other printers or copiers that due to technically conditioned positional displacements of the toner images and/or the paper web 10 additional and/or varied delay times for opening and/or closing of the covering device 16 have to be provided. In addition, it might be useful to adapt the acceleration curves and, possibly, the speeds in order to truly prevent that areas of the paper web 10 are not fixed. The opening of the covering device 16 during an ongoing transport of the paper web 10 as well as the deceleration of the covering device 16 in the opened position should take place as fast as technically possible.

When the covering device 16 is decelerated in the open position, however, the deceleration should take place as fast as possible only in the case of a complete opening of the covering device 16, in other cases it might be useful to adapt the closing speed exactly to the speed of the paper web 10. However, both the acceleration to transport speed $v_R$ as well as the deceleration from transport speed $v_R$ are technically limited due to a maximum allowable tensile load on the lamellae 24 to 40 and the power of the drive unit of the covering device 16. In the illustrated embodiment, both for the paper web 10 as well as for the covering device 16 identical possible acceleration and deceleration curves have been used. In other embodiments, the paper web 10 and the covering device 16 can also be accelerated and decelerated differently. However, the closing of the covering device 16 preferably takes place with an acceleration which, with regard to its magnitude, substantially corresponds to the negative acceleration of the paper web 10 during the deceleration of the paper web 10. As a result, the drive of the paper web 10 is decelerated and the covering device 16 is simultaneously accelerated in the closing direction. As a result, an identical radiation period is achieved even in the case of a slower movement of the paper web. In general, a slower movement of the paper web requires a shorter radiation distance for an identical radiation period.

In printing processes, in which the covering device 16 is only incompletely opened, an acceleration of the covering device 16 to transport speed $v_R$ as fast as possible should likewise take place, which transport speed $v_R$ corresponds magnitude-wise to the transport speed $v_P$ of the paper web 10. However, the closing of the covering device 16 should take place with the same magnitude of acceleration as the deceleration of the transport speed of the paper web 10.

In practice, a sudden, i.e. jump-wise change of the speed $v_R$ of the covering device 16 is technically not possible. For improving the exactness of the positioning of the area of the paper web 10 fixed during the first printing process and of the area of the paper web 10 fixed during the second printing process, the speed $v_R$ can be increased magnitude-wise for a predetermined time as compared to the speed $v_P$, as a result whereof exposure errors due to acceleration and deceleration influences can at least again be compensated. An area of the paper web 10, which during the acceleration phase of the covering device 16 already again disappeared under the just opening covering device 16, is again cleared by the increased transport speed $v_R$ of the covering device 16 so that radiation is again incident on this area.

In addition, it is possible to provide the acceleration and deceleration travels of the covering device 16 exclusively in the areas S1, S2, in which in the case of a movement of the covering device 16 the ray path from the radiation sources 12, 14 to the paper web 10 is not influenced. As a result, the limited acceleration capability of the covering device 16 has no influence on the uniform clearance or, respectively, interruption of the ray path. This is at least the case when the acceleration of the covering device 16 to the transport speed of the paper web 10 as well as the deceleration from transport speed to the standstill are to be carried out completely within these areas S1, S2. The covering device 16 then always has the same speed $v_R$ in the radiation area during opening and closing, as a result whereof an exact area of the paper web 10 is fixed. By means of these exactly determined areas which are either completely fixed or which are substantially not yet fixed, it is possible that the front edge of an area fixed in the second printing process exactly borders on the rear edge of an area fixed in the first printing process so that neither areas which are fixed twice nor areas which are not yet fixed occur.

In alternative embodiments, individual sheets are used as carrier material 10 instead of the paper web.

While preferred embodiments have been illustrated and described in detail in the drawings and foregoing description, the same is to be considered as illustrative and not restrictive in character, it being understood that only the preferred embodiments have been shown and described and that all changes and modifications that come within the spirit of the invention both now or in the future are desired to be protected.

We claim:

1. A method for fixing toner images on a carrier material, said method comprising the steps of:

providing a heating device having at least one heat radiation source emitting radiation toward the carrier material, the carrier material being moved in a first direction of movement and in a second direction of movement substantially opposite to the first direction of movement, said heating device having a covering device movable substantially parallel to the first and second directions of movement of the carrier material into the ray path between the heat radiation source and the carrier material, opening the covering device when the carrier material is moved in the first direction of movement for fixing toner images on the carrier material;

closing the covering device during standstill of the carrier material and during transport of the carrier material in the second direction of movement; and after moving the carrier material in the second direction of movement, opening the covering device during a subsequent movement of the carrier material in the first direction of movement in a delayed manner so that at least an already completely fixed area of the carrier material is not again subjected to the radiation of the heat radiation source.

2. A method according to claim 1, which includes supplying substantially only as much radiation to an incompletely fixed area of the carrier material so that a toner image present in this area is completely fixed.

3. A method according to claim 1, wherein the covering device is opened in the direction of the first direction of movement, and when the covering device is opened, the rear edge of the already fixed area is already guided past the point at which the ray path is first cleared when the covering device is opened.

4. A method according to claim 1, wherein the opening speed of the covering device substantially corresponds to the transport speed of the carrier material.

5. A method according to claim 1, wherein the covering device is closed in the direction of the first direction of movement, and the closing speed substantially corresponds to the transport speed of the carrier material.

6. A method according to claim 1, which includes, after stopping the carrier material, closing the covering device in the direction of the second direction of movement, with a closing speed substantially corresponding to the transport speed of the carrier material.

7. A method according to claim 1, which includes determining the completely fixed area and using the determined area to adjust an acceleration characteristic of the covering device during closing of the covering device.

8. A method according to claim 1, which includes determining a delay time for the delayed opening of the covering device and using the determined delay time to adjust an acceleration characteristic of the covering device during the opening of the covering device.

9. A method according to claim 1, wherein the carrier material is only conveyed in the second direction of movement after the covering device has been closed.

10. A method according to claim 1, wherein the acceleration of the carrier material for starting and stopping the transport of the carrier material substantially corresponds to the acceleration of the covering device during opening and closing.

11. A method according to claim 1, wherein the speed of the covering device is increased for a preset time interval at the beginning of an opening process and the beginning of a closing process.

12. A method according to claim 1, wherein, during an acceleration process for opening the covering device, a ray path from the heat radiation source to the carrier material is not yet cleared and, during the acceleration process after the opening of the covering device, no additional ray path from the heat radiation source to the carrier material is uncovered.

13. A method according to claim 1, wherein, during an acceleration process for closing the covering device, a ray path from the heat radiation source to the carrier material is not yet interrupted and, during the acceleration process after the closing of the covering device, no additional ray path from the heat radiation source to the carrier material is interrupted.

14. A method according to claim 1, which includes adjusting the fixing power by adjusting an opening position of the covering device.

15. A fixing station for fixing toner images on a carrier material, said station comprising:

a heating device having at least one heat radiation source which emits radiation toward the carrier material;

a drive unit, which conveys the carrier material in a first direction of movement and in a second direction of movement substantially opposite to the first direction of movement; and a covering device which can be moved substantially parallel to the first and second directions of movement of the carrier material and is movable into the ray path between the heat radiation source and the carrier material, the covering device being opened for fixing toner images on the carrier material during the transport of the carrier material in the first direction of movement, the covering device being closed during the transport of the carrier material in the second direction of movement, and, after moving of the carrier material in the second direction of movement, the covering device being opened during the subsequent movement of the carrier material in the first direction of movement in a delayed manner so that at least the radiation does not impinge on an already completely fixed area of the carrier material.

16. A fixing station according to claim 15, wherein the covering device has at least the width of the carrier material.

17. A fixing station according to claim 15, wherein the covering device is flexible in the direction of movement of the carrier material.

18. A fixing station according to claim 15, wherein the covering device includes a band.

19. A fixing station according to claim 15, wherein the covering device includes a plurality of strip-shaped lamellae, which form a blind with adjacent lamellae overlapping one another.

20. A fixing station according to claim 15, wherein the covering device is a flexible band which can be wound up like a coil.

21. A fixing station according to claim 15, which includes an endless deflection device arranged around the heating device, and the covering being a blind movable along the deflection device.

22. A fixing station according to claim 15, wherein the covering device is of a length which is sufficient to shield the carrier material from the entire radiation of the heat radiation source toward the carrier material.

23. A fixing station according to claim 15, wherein, during a standstill of the carrier material, the covering device is moved at the speed vR, according to the relation:

$$vR=-vP.$$

where vP is the transport speed of the carrier material.

24. A fixing station according to claim 15, wherein, during additional transport of the carrier material at the speed vP, the covering device is moved at the speed vR according to the relation:

$$vR=vP.$$

25. A fixing station according to claim 15, wherein the covering device includes a rigid plate for shielding the radiation.

26. A fixing station according to claim 15, wherein the heat radiation source has a radiation temperature in the range of 500° C. to 900° C. and the maximum radiation intensity is at a wavelength of greater than 2 μm.

27. A fixing station according to claim 15, which includes two heating devices arranged with the carrier material passing therebetween, each heating device having at least one heat radiation source and a covering device being movable into the ray path between the heat radiation source and the carrier material, both covering devices being preferably moved by a common drive.

28. A fixing station according to claim 15, which is used with a device selected from a group consisting of a printing device and a copying device which operates in the duplex printing mode.

29. A fixing station according to claim 15, the heat radiation source is selected from a group consisting of a ceramic panel radiator, a quartz radiator and a foil radiator.

30. A fixing station according to claim 29, wherein the heat radiation source is preheated.

31. A fixing station according to claim 30, wherein the heat radiation source is preheated to a temperature of higher than 200° C.

* * * * *